US011168912B2

(12) United States Patent
Hu et al.

(10) Patent No.: US 11,168,912 B2
(45) Date of Patent: Nov. 9, 2021

(54) AIR CONDITIONER DRIVING DEVICE

(71) Applicant: Guangzhou Guangju Intelligent Technology Co., Ltd., Guangzhou (CN)

(72) Inventors: Jun Hu, Guangzhou (CN); Yongming Deng, Guangzhou (CN); Ping Liu, Guangzhou (CN)

(73) Assignee: Botao Zhang, Beijing (CN)

( * ) Notice: Subject to any disclaimer, the term of this patent is extended or adjusted under 35 U.S.C. 154(b) by 0 days.

(21) Appl. No.: 16/056,608

(22) Filed: Aug. 7, 2018

(65) Prior Publication Data

US 2018/0372360 A1 Dec. 27, 2018

Related U.S. Application Data

(63) Continuation of application No. PCT/CN2015/075344, filed on Mar. 29, 2015.

(30) Foreign Application Priority Data

Jan. 28, 2015 (CN) ..... 201510045356.1

(51) Int. Cl.
*F24F 11/46* (2018.01)
*F24F 11/63* (2018.01)
(Continued)

(52) U.S. Cl.
CPC ..... *F24F 11/46* (2018.01); *F24F 11/63* (2018.01); *F24F 2110/10* (2018.01);
(Continued)

(58) Field of Classification Search
CPC ..... F24F 11/46; F24F 11/63; F24F 2120/10; F24F 11/30; F24F 2110/20;
(Continued)

(56) References Cited

U.S. PATENT DOCUMENTS

2011/0240750 A1* 10/2011 Tokura ..... G01S 13/56 236/51
2013/0217491 A1* 8/2013 Hilbert ..... A63F 13/00 463/31
(Continued)

FOREIGN PATENT DOCUMENTS

CN 101232760 7/2008
CN 201351979 11/2009
(Continued)

OTHER PUBLICATIONS

Kuroda, Air Conditioner, Feb. 5, 2004, JP2004036990A, Whole Document (Year: 2004).*
(Continued)

*Primary Examiner* — Larry L Furdge
(74) *Attorney, Agent, or Firm* — Dragon Sun Law Firm, PC; Jinggao Li, Esq.

(57) ABSTRACT

The present disclosure discloses an air conditioner driving device, and the air conditioner driving device comprises a sensing unit and a processing unit, wherein the sensing unit at least comprises a microwave sensing module; the sensing unit is at least used for sensing whether any human activity exists within the action range based on microwave sensing according to a certain microwave sensing cycle, and periodically outputting a sensing signal to the processing unit; and the processing unit is used for processing the sensing signal, so that the driving device can adaptively control the turn-on and turn-off of the air conditioner and adaptively regulate the working power of the air conditioner. Based on this, a dynamic intelligent air conditioner driving device without a user's turn-on and turn-off action and based on environmental state sensing is realized.

5 Claims, 6 Drawing Sheets

(51) Int. Cl.

| | |
|---|---|
| *F24F 110/20* | (2018.01) |
| *F24F 110/10* | (2018.01) |
| *F24F 110/30* | (2018.01) |
| *F24F 110/32* | (2018.01) |
| *F24F 110/22* | (2018.01) |
| *F24F 120/14* | (2018.01) |
| *F24F 110/12* | (2018.01) |

(52) U.S. Cl.
CPC ..... *F24F 2110/12* (2018.01); *F24F 2110/20* (2018.01); *F24F 2110/22* (2018.01); *F24F 2110/30* (2018.01); *F24F 2110/32* (2018.01); *F24F 2120/14* (2018.01)

(58) Field of Classification Search
CPC ..... F24F 2110/32; F24F 2110/22; F24F 2110/30; F24F 2110/10; F24F 2110/12; F24F 2120/14
See application file for complete search history.

(56) References Cited

U.S. PATENT DOCUMENTS

2013/0325368 A1* 12/2013 Robb ..... G01P 5/00 702/45
2014/0056286 A1* 2/2014 Nagata ..... H04W 74/0808 370/336

FOREIGN PATENT DOCUMENTS

| | | | | |
|---|---|---|---|---|
| CN | 101639273 | | | 2/2010 |
| CN | 201628340 | | | 11/2010 |
| CN | 201672623 | | | 12/2010 |
| CN | 201866885 | | | 6/2011 |
| CN | 102374608 | | | 3/2012 |
| CN | 102374613 | | | 3/2012 |
| CN | 202709381 | | | 1/2013 |
| CN | 201314675 | | | 9/2013 |
| CN | 103363625 | | | 10/2013 |
| CN | 103884082 | | | 6/2014 |
| JP | H0587393 | A | * | 4/1993 |
| JP | 2004036990 | A | * | 2/2004 |
| JP | 2007132577 | A | * | 5/2007 |
| JP | 2014035115 | A | * | 2/2014 |
| KR | 1020110045798 | | | 5/2011 |

OTHER PUBLICATIONS

Inuzuka et al., Air Flow Regulatorfor Air Conditioning Floor Blow-off Port, Apr. 6, 1993, JPH0587393A, Whole Document (Year: 1993).*
Nagai, Radio Air Conditioning Control System . . . , May 31, 2007, JP2007132577A, Whole Document (Year: 2007).*
Sugiyama et al., Air Conditioner, Feb. 24, 2014, JP2014035115A, Whole Document (Year: 2014).*
International Search Report from corresponding PCT/CN2015/075344.
International Written Opinion from corresponding PCT/CN2015/075344.
International preliminary report from corresponding PCT/CN2015/075344.
1st office action for Chinese patent application 201510045356.1.

* cited by examiner

AIR CONDITIONER DRIVING DEVICE

CROSS-REFERENCE TO RELATED APPLICATIONS

This application claims priority from PCT Application No. PCT/CN2015/075344, filed Mar. 29, 2015 and CN Application No. 201510045356.1, filed Jan. 28, 2015, the contents of which are incorporated herein in the entirety by reference.

TECHNICAL FIELD

The present disclosure relates to the field of air conditioners, and in particular to an air conditioner driving device.

BACKGROUND

On one hand, in the prior art, controlled turn-on and turn-off and power regulation of an air conditioner are realized through an air conditioner control panel or various remote controllers. In other words, in the prior art, an air conditioner needs to be controlled by manual turn-on and turn-off actions, and the intelligence degree is limited.

On the other hand, when an air conditioner is driven, no matter whether the air conditioner is a constant frequency air conditioner or a variable frequency air conditioner and no matter what is the mounting occasion, the corresponding environment needs always change. Even a central control system is mounted, a person also needs to monitor and manage at a monitoring center. Each specific air conditioner cannot automatically sense dynamic changes in the environment according to the people flow of the environment so as to operate at different power levels through regulation. In other words, the purposes that in the prior art, the air conditioner is automatically turned on and turned off due to people flow to save energy and prolong the service life, cannot be realized.

SUMMARY

For that reason, in order to solve one or more of the technical problems, the present disclosure provides an air conditioner driving device which is characterized in that:

the driving device comprises a sensing unit and a processing unit, wherein the sensing unit at least comprises a microwave sensing module; the sensing unit is at least used for sensing whether any human activity exists within the action range based on microwave sensing according to a certain microwave sensing cycle, and periodically outputting a sensing signal to the processing unit; and the processing unit is used for processing the sensing signal, so that the driving device can adaptively control the turn-on and turn-off of the air conditioner and adaptively regulate the working power of the air conditioner.

Through the technical scheme, a dynamic air conditioner driving device without a user's turn-on and turn-off action and based on environmental state sensing, which not only is energy-saving but also is intelligent, can be realized.

DETAILED DESCRIPTION

Figure 1:
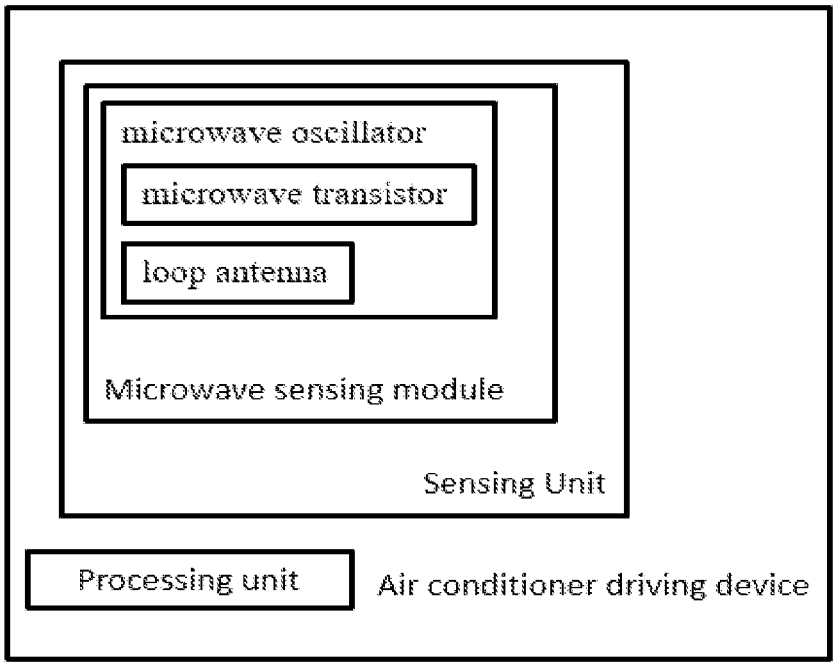
FIG. 1 is a structural diagram of a device in one embodiment of the present disclosure.

In the following embodiments, the air conditioner disclosed by the disclosure is neither limited to being used for refrigeration or heating, nor limited to focusing on regulating air velocity and humidity.

By reference to FIG. 1 to FIG. 11, one embodiment discloses an air conditioner driving device, wherein the driving device comprises a sensing unit and a processing unit, wherein the sensing unit at least comprises a microwave sensing module;

the sensing unit is at least used for sensing whether any human activity exists within the action range based on microwave sensing according to a certain microwave sensing cycle, and periodically outputting a sensing signal to the processing unit; and the processing unit is used for processing the sensing signal, so that the driving device can adaptively control the turn-on and turn-off of the air conditioner and adaptively regulate the working power of the air conditioner.

Through the technical scheme, a dynamic air conditioner driving device without a user's turn-on and turn-off action and based on human or object activities can be realized through the microwave sensing module, so that an intelligent air conditioner driving device based on environmental state sensing is realized. The air conditioner driving device neither needs a user's turn-on and turn-off actions, nor needs the user's regulating the working power of the air conditioner, typically, for example, forced refrigeration and forced heating.

Obviously, the embodiment does not need any original switch for a user to turn on and turn off the air conditioner or regulate the power of the air conditioner. The obvious difference from control of an air conditioner through intelligent terminals such as intelligent phones and tablet PCs lies in that the embodiment does not need any user intervention. The air conditioner driving device can autonomously manage the air conditioner.

The technical scheme of the embodiment can obviously meet the following demands that: when the air conditioner can adapt to long-term low-temperature environment for heating, adapt to long-term high-temperature environment for refrigeration or adapt to long-term poorly-ventilated environment for ventilation, if a user wants that the air conditioner can be automatically turned on when someone is present and automatically turned off when not person is present and also wants that the power of the air conditioner can be further regulated according to sensed human activities, for example, more specifically, the power is increased when someone is close to the microwave sensing module and reduced when someone is further away from the microwave sensing module; and generally, the power is increased when signals reflected by human activities sensed by microwaves are stronger and reduced when the signals are weaker. Microwave signals corresponding to different movement frequency features, different people flows, and the like can be selectively recognized so as to be used for the technical scheme of the disclosure.

Preferably, in another embodiment, the change amplitude of the power level can be customized. For example, the change amplitude can specifically be different differences. If the rated power is defined as 100%, then the change amplitude can include but is not limited to the following examples: 70%, 50%, 30%, 20%, 10% and 5%.

Preferably, in another embodiment, the processing unit comprises a signal processing module, a control module and an air conditioner driving module, wherein the signal processing module is used for processing a signal output by the sensing unit into a digital signal required by the control module and outputting the digital signal to the control module, the control module is used for outputting a control signal to the air conditioner driving module after conducting fuzzy operation on the received digital signal and comparing the digital signal with control strategies in a database; and the air conditioner driving module is used for adaptively controlling the turn-on and turn-off of the air conditioner and adaptively regulating the working power of the air conditioner according to the control signal.

The embodiment gives a realization way of the processing unit. Obviously, if the manufacturing technology permits, the signal processing module can also be highly integrated with the control module even the air conditioner driving module, provided the function of the signal processing module can be realized, wherein the control module can be realized through various suitable processors. Moreover, because sensing signals acquired by quite numerous sensors are analog signals and certain sensors can directly convert the sensing signals into digital signals, the signal processing module is not limited to various ADCs (analog-digital converters) suitable for the disclosure. Assuming that a certain sensing signal is processed by the sensor into a digital signal, then as described in the embodiment, the signal processing module processes the signal output by the sensing unit into a digital signal required by the control module and outputs the digital signal to the control module. The embodiment reflects the technical route of the present disclosure from one side, i.e. the turn-on and turn-off and the power regulation of the air conditioner are controlled through specific module design of the processing unit by taking the control strategies in the database as a core. Under the premise of meeting basic performance requirements, how to conduct fuzzy operation on data is not important. The fuzzy operation or fuzzy computation method in mathematics can both be used.

Preferably, in another embodiment, the control strategies in the database comprise the following rules:

(1) when the air conditioner is in the turn-off state or the standby state, if the digital signal is judged to be unchanged by comparing the current sensing moment with the sensing moment in the last cycle, a control signal in the turn-off state or the standby state is maintained continuously, so that the air conditioner maintains the turn-off state or the standby state; or else, a control signal is outputted and maintained according to the current environment temperature and humidity, so that the working state of the air conditioner is regulated to the working state corresponding to the current environment temperature and humidity; and (2) when the air conditioner is in the working state at a certain power level, if the digital signal is judged to be unchanged by comparing the current sensing moment with the sensing moment in the last cycle, a control signal in the current working state is maintained continuously, so that the air conditioner continues to maintain the working state at the current power level.

Furthermore, if at a certain interval sensing moment after a certain interval of the current sensing moment, the digital signal is still judged to be unchanged within the certain interval, then a control signal is outputted, so that the working state of the air conditioner is regulated to the working state with one level below the current power level; or else, a control signal is outputted, so that the working state of the air conditioner is regulated to the working state with one level above the current power level, wherein the working state with one level below the current power level comprises the air conditioner standby or turn-off working state corresponding to the minimum power level; and the working state with one level above the current power level comprises the working state with the maximum power level being 100% and of the rated power.

The embodiment realizes the control strategies in the database in a better way and gives specific program control rules which are characterized in that the minimum power level of the air conditioner can correspond to the turn-off state and can also be set as the standby state, which can be set when the air conditioner leaves the factory and can also be freely selected by the user. No matter whether the air conditioner is in a turn-off or standby state or a turn-on state, cyclic detection is conducted at a certain interval, and the working power level of the air conditioner is reduced or increased step by step in the working state corresponding to the current environment temperature and humidity. The stepwise regulation doesn't happen all the time, when no change is sensed during a certain time range, the driving device changes the power level until the air conditioner is in the standby state or the turn-off state only when the driving device considers that human activity does not exist, or else the air conditioner carries out heating or refrigeration according to the original power level and a preset target value to reach the temperature indicated by the target value, or carries out ventilation according to the target value to reach the air velocity indicated by the target value, or carries out humidification or dehumidification according to the target value to reach humidity indicated by the target value; and however, as for the working state from the turn-off state or the standby state to the turn-on state, it is hoped to regulate it to the working state corresponding to the current environment temperature and/or humidity as quickly as possible rather than after a period of time. Surely, because not all control strategies can be listed one by one, the driving device disclosed by the present disclosure does not exclude selection of other control strategies according to specific demands of air conditioner usage occasions.

The working state corresponding to the current environment temperature and humidity neither excludes the turn-off state or the standby state currently nor excludes the power level with low power consumption corresponding to certain current environment temperature and humidity currently. For example, for long-term low-temperature environment or long-term high-temperature environment, the air conditioner is hoped to always heat or refrigerate when someone is present; and while in the environment with relatively-distinct seasons, the air conditioner is hoped to always heat, refrigerate, ventilate, humidify or dehumidify if someone is present when the environment temperature and humidity reach turn-on conditions.

The turn-off state does not exclude the thorough power-off state.

The standby state does not exclude maintaining the air conditioner sleep state and the air conditioner standby state at different low power consumption levels; for example, when the air conditioner is switched from the sleep state to the normal working state, a long time is needed to awaken all functional elements; and when the air conditioner is switched from the standby state to the normal working state, only a short time is needed to awaken all functional elements.

The preset target value can be a default value set when the air conditioner leaves the factory, and can also be a user value freely set when the user wants to set the value freely. The preset target value disclosed by the disclosure can be a value or a value range. For example, by default, the preferable temperature of living environment of people is assumed to be set as 26 DEG C. in summer and as 20 DEG C. in winter. No matter whether the air conditioner is in the heating mode or the refrigeration mode, the temperature is regulated by taking the temperature set by programs as the target value; similarly, by default, if the preferable air velocity of living environment of people is assumed to be set as 20 cm/s, the air velocity is regulated by taking 20 cm/s as the target value when the air conditioner is only used for ventilation; and naturally, the ventilation function can be combined with the refrigeration or heating function to comprehensively regulate and control the air conditioner, and the air velocity preset target value can also be set as factory settings or user-defined settings according to the local climatic conditions of the user represented by local latitude, longitude, humidity, summer and winter coming and ending time, and the like. For example, in winter, people hope the air velocity to be slightly low to prevent feeling cold. Similarly, by default, the preferable humidity of living environment of people is assumed to be 30%-80% in winter and 30%-60% in summer.

Furthermore, as for the air conditioner, the disclosure does not exclude adaptively increasing or reducing the power of the air conditioner by comparing the differences between the preset target values and actually-sensed environment temperature, humidity and air velocity currently. For example, by taking temperature difference and regulation of a fan of a conventional air conditioner as examples, when the room temperature differs by 10 DEG C. or more from the preset target value, the fan speed of the air conditioner is in the high-air volume mode; when the temperature differs by 5 DEG C., the fan automatically switches to the medium-air volume mode; and when the environment temperature is more approximate to the preset target value, the fan automatically switches to the low-air volume mode.

Preferably, in another embodiment, the sensing unit also comprises an environment temperature and humidity sensing module, and the environment temperature and humidity sensing module is used for periodically outputting an environment temperature and humidity sensing signal to the processing unit according to a certain temperature cycle and a certain humidity sensing cycle and based on temperature and humidity sensing in the environment where the air conditioner works, so that the processing unit uses the environment temperature and humidity sensing signal to adaptively control the turn-on and the turn-off of the air conditioner and adaptively regulate the working power of the air conditioner.

In the embodiment, the environment temperature and humidity sensing module is additionally arranged, and assists in controlling the turn-on and turn-off and the power regulation of the air conditioner by sensing environment temperature and humidity. For example, when the current environment temperature and humidity conditions are very good, it is not necessary to continue to regulate air temperature and humidity according to microwave sensed results even not necessary to turn on the air conditioner, and vice versa. That is to say, the embodiment can further provide more intelligent power regulation by sensing the temperature and the humidity of the current air conditioner environment on the basis of all previous embodiments, and correct the problem of too low or too high power caused by simple microwave sensing. In other words, the air conditioner can be turned on only when the environment temperature and humidity sensed by the environment temperature and humidity sensing module conform to the air conditioner turn-on conditions. Naturally, the embodiment can also be combined with air velocity regulation to comprehensively regulate air.

Preferably, the environment temperature and humidity sensing module comprises an infrared sensor.

For example, the air conditioner driving device disclosed by the present disclosure can only control the turn-on and turn-off and power regulation of air conditioners within a certain range of an infrared signal source, and the rest air conditioners far from the infrared signal sources maintain the normally-off state. Furthermore, infrared signals of humans are different from those of other animals, and the movement frequencies are also different. The supplementary means can also be combined with microwave sensing to prevent air conditioners from being falsely triggered by movements of other animals or objects.

Preferably, in another embodiment, the sensing unit also comprises an air velocity sensing module, and the air velocity sensing module is used for periodically outputting an air velocity sensing signal to the processing unit according to a certain air velocity sensing cycle and based on air velocity sensing in the environment where the air conditioner works, so that the processing unit uses the air velocity sensing signal to adaptively control the turn-on and the turn-off of the air conditioner and adaptively regulate the working power of the air conditioner.

As clearly indicated in the embodiment, the air conditioner driving device disclosed by the disclosure can further reflect the intelligence and energy saving performance of the air velocity sensing module.

It should be noted that the environment temperature and humidity sensing module and the air velocity sensing module can well cooperate with the microwave sensing module. Not only can the turn-on and turn-off and power regulation of the air conditioner be controlled through each sensing module independently as needed, but also the turn-on and turn-off and power regulation of the air conditioner can be controlled in a linkage way through two or three sensing modules as needed. Specific control rules can be developed as appropriate: generally, in order to better save energy, it is recommended to determine whether the most basic regulation for turning on the air conditioner is met or not according to the measuring signals of the environment temperature and humidity sensing modules; and if yes, the air conditioner is further turned on and off and the power of the air conditioner is regulated according to other sensing modules such as the microwave sensing module and/or the air velocity sensing module.

Preferably, in another embodiment, according to different effects of the surface area features and the movement features of humans and other objects and distances to the microwave sensing module on microwave sensing signals as well as the temperature features of humans and other objects, the processing unit is used to prevent other objects from falsely triggering the turn-on and turn-off of the air conditioner and falsely triggering power regulation.

For the embodiment, such false triggering action possibly caused by other objects includes but is not limited to the movement of a small animal and the sudden fall of an object. Because such objects have different surface areas and particularly different microwave-receiving surface areas from humans, the features of such surface areas have an effect on the microwave sensing signal. In addition, the distances to the microwave sensing module have an effect on the microwave sensing signal, and the movement features also have an effect on the microwave sensing signal. The air conditioner driving device disclosed by the present disclosure can formulate control strategies based on the three effects to prevent falsely triggering the turn-on/turn-off and power regulation of the air conditioner. Moreover, as humans have different temperature features from other objects, the air conditioner driving device disclosed by the present disclosure can also introduce the temperature features into other embodiments to prevent falsely triggering the turn-on/turn-off and power regulation of the air conditioner by means of a joint action between an infrared sensing module or temperature sensing module of another type and the microwave sensing module. More specifically, it is assumed that a microwave oscillator with an operating frequency of 5.4 GHz and consisting of a loop antenna and a microwave transistor is arranged in the microwave sensing module. After the PN junctions of a semiconductor of the internal microwave transistor are subjected to frequency mixing, weak frequency-shift signals (such as detected human movement signals) are detected by a beat method. The processing unit can remove interfering signals with too small amplitude firstly, and then only convert the detected frequency-shift signals with a certain strength into constant-amplitude pulses with different widths. The circuit only identifies a single signal with an enough pulse width. Therefore, the movement change of a human body triggers a meaningful signal; correspondingly, weaker interfering signals generated by small animals, high-frequency communication signals, distant lightning and the turn-on and turn-off of household appliances can be eliminated. In other words, the processing unit can identify the signals which are really big enough and conform to a meaningful principle, such as human body movement signals. Only by successfully identifying such signals, the processing unit can output corresponding control signals to control the air conditioner driving module to operate, so as to prevent a false triggering action.

Preferably, in another embodiment, the certain microwave sensing cycle, the certain temperature sensing cycle, the certain humidity sensing cycle and the certain air velocity sensing cycle are different. In such case, the corresponding operating cycles of multiple sensing modules are somewhat different. However, the air conditioner control function is not interfered. The embodiment defines a specific method for realizing sensing cycles. Similarly, in another embodiment, the certain microwave sensing cycle, the certain temperature sensing cycle, the certain humidity sensing cycle and the certain air velocity sensing cycle can be the same cycle T. More preferably, the same cycle T is 1 s.

For the embodiments relevant to cycles, the cycles can be changed and reset at any time. Either sensing by cycle can be set in the sensing unit or processing by cycle can be set in the processing unit, and both sensing by cycle and processing by cycle can also be set. Regardless of which setting method is adopted, the adaptive on-off control and power regulation of the air conditioner without requiring a switch in the present disclosure shall be available.

Preferably, in another embodiment, when the user waves one hand, the microwave sensing module can sense the hand-waving movement without help of any additional modules. The processing unit is also used for increasing or reducing power based on the current power level or regulating power to certain power.

For the embodiment, the hand waving regulation defined in the present disclosure can achieve the intelligent hand-waving regulation function without additional devices. Various regulation control strategies corresponding to hand-waving movements are added in the database, so that the hand-waving regulation function can be realized. After waveform information obtained after information expressed by a hand-waving movement sensed by the sensor for microwave sensing is processed by the signal processing module is compared with the database, a regulation command is generated and transmitted to the air conditioner driving module for execution. As various human body movements in real life have a difficulty in reaching a frequency of 5 Hz or above through a lot of data collection and simulations, the air conditioner driving device disclosed by the disclosure can judge whether a human body makes a low-frequency movement of not higher than 5 Hz in the range of activities. Generally speaking, if there is a requirement on the power of the air conditioner, frequency generated by a human's conscious hand-waving movement required for regulation is greater than 5 Hz, which is exactly a starting point for the disclosure to fulfil the hand-waving regulation function. On specific occasions, the threshold herein may be a threshold being lower or higher than 5 Hz, which will not hamper the implementation of the technical scheme in the disclosure. A 5 Hz threshold is taken for instance: after the sensor for microwave sensing senses a movement frequency greater than 5 Hz, the waveform outputted to the signal processing module has greater difference from that of other movements. The waveform corresponding to such hand-waving movement is processed by the signal processing module and then transmitted to the processing unit for fuzzy processing. Then the power is controlled according to a preset regulation strategy, such as 80% or 50%; of course, the regulation strategy can also be one for increasing or reducing power at the current power level. The power is increased or reduced again during another hand-waving movement after a certain time interval.

Figure 2:
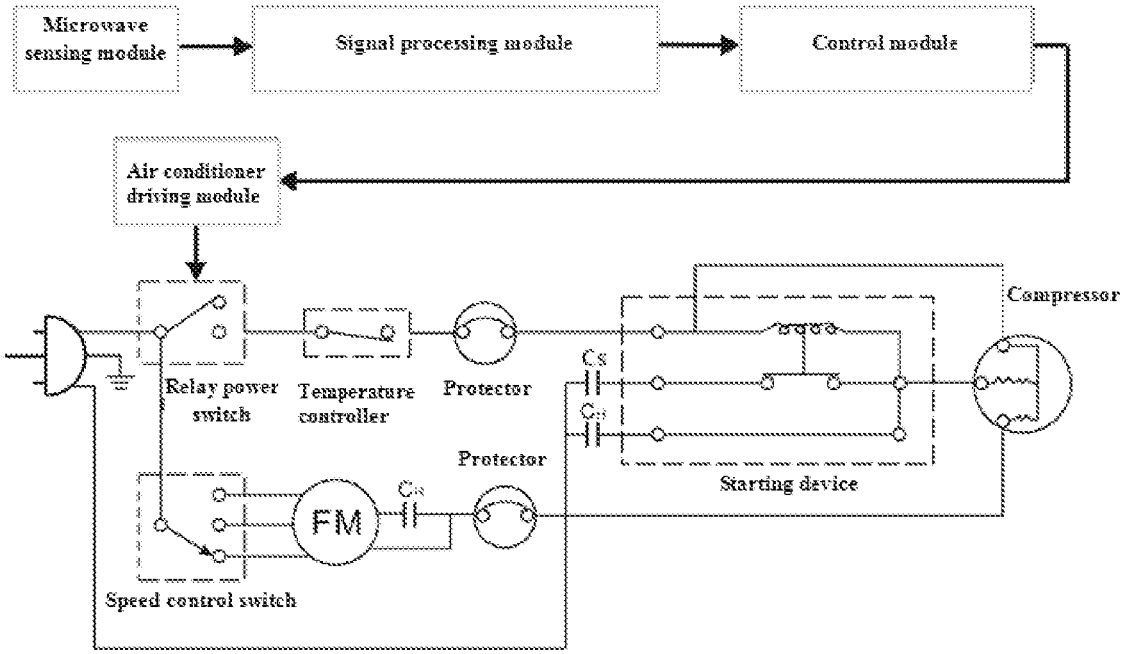
FIG. 2 is a circuit diagram of a constant frequency air conditioner driving device in one embodiment of the present disclosure.
Figure 3:
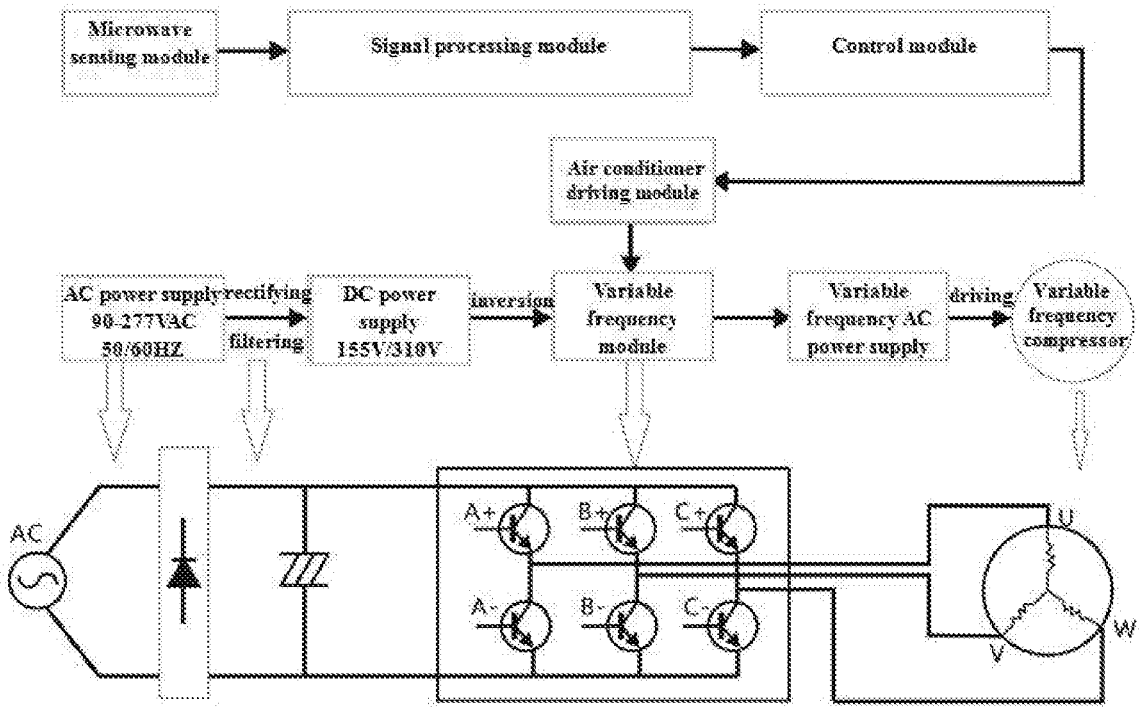
FIG. 3 is a circuit diagram of a variable frequency air conditioner driving device in one embodiment of the present disclosure.

For the constant frequency air conditioner and the variable frequency air conditioner, FIG. 2 and FIG. 3 respectively show the realization principle of the driving device disclosed by the disclosure. Take heating or refrigeration for instance: for the constant frequency air conditioner, the air conditioner driving module disclosed by the disclosure can control whether a relay of the constant frequency air conditioner is conducted or not to control the operating time of a compressor. For the variable frequency air conditioner with an AC variable frequency compressor, the air conditioner driving module disclosed by the disclosure can perform pulse width modulation on the compressor through sine wave pulses; and for the variable frequency air conditioner with a DC variable frequency compressor, the air conditioner driving module disclosed by the disclosure can perform pulse width modulation on the compressor through square wave pulses.

More preferably, in order to protect the compressor, starting the compressor again 3 to 5 minutes after the last shutdown can be considered.

Furthermore, another embodiment is shown as below. The following hexadecimal data is the real-time AD sampled values measured by the microwave sensing module within a certain time period when a human body is in a static state basically with no obvious movements, as shown in FIG. 4, which reflects microwave sensing data of the human body in the static state.

8A 8A 8B 8A 8A 8A 8A 8A 8A 8B 8A 8A 8A 8A 89 8A
89 8A 8A 8A 8A 8A 8B 8A 8B 8A 8B 8B 8B 8C 8C 8C 8C
8B 8C 8C 8C 8D 8D 8D 8D 8D 8E 8E 8D 8E 8D 8E 8D 8D
8D 8D 8C 8C 8C 8C 8C 8D 8C 8C 8C 8C 8D 8C 8D 8D
8D 8D 8D 8D 8D 8D 8D 8E 8D 8E 8E 8E 8E 8E 8E 8F 8E
8F 8F 8F 8F 8F 8F 8E 8E 8E 8E 8D 8D 8D 8C 8D 8D 8D
8D 8D 8D 8C 8D 8C 8D 8C 8C 8B 8C 8C 8C 8C 8B 8B 8B
8B 8B 8C 8C 8C 8C 8C 8C 8B 8B 8B 8C 8B 8B 8B 8B 8A
8B 8B 8A 8B 8B 8B 8B 8B 8C 8C 8B 8B 8B 8B 8C 8B 8B
8A 8A 8A 8A 8A 8A 8A 8A 8A 8A 89 8A 89 8A 89 89 89
89 89 89 89 89 89 88 88 88 88 87 88 88 88 88 88 88 87 88
87 87 87 87 87 87 87 87 87 87 86 87 87 88 88 88 88 87 88
88 87 87 87 87 87 87 87 87 87 88 87 87 87 87 88 87 88 87
88 87 88 87 88 87 87 87 87 88 88 89 88 89 88 89 89 8A 89
89 89 89 8A 89 8A 8A 8A 89 8A 89 89 8A 8A 89 89 89 8A 8A
8A 8A 8A 8A 89 8A 89 89 89 89 88 89 88 88 89 88 88 88
88 88 89 89 88 88 88 88 88 88 88 88 88 88 87 88 87 88 87
88 87 88 88 88 88 88 88 88 88 88 88 88 88 88 88 88 88 87
87 87 87 88 89 88 88 88 89 88 89 88 88 89 88 88 89 89
89 89 89 8A 8A 8A 8A 8A 8B 8A 8B 8A 8B 8A 8B 8A
8A 8A 8A 8A 8A 8A 8A 8A 8B 8A 8A 8A 8A 8B 8A 8A
8B 8A 8B 8B 8B 8A 8B 8B 8B 8C 8C 8C 8C 8C 8C 8C 8C
8C 8C 8B 8B 8B 8B 8B 8B 8B 8A 8B 8B 8B 8B 8B 8B
8B 8A 8A 89 8A 89 8A 89 89 89 8A 8A 8A 8A 8A 8A 8B
8B 8A 8B 8B 8B 8B 8A 8A 8A 8A 8A 89 8A 8A 8A 8A 89
8A 8A 8A 8A 8B 89 8A 8A 8A 8B 8B 8A 8A 8A 8B 8B 8B
8B 8B 8B 8B 8B 8C 8C 8C 8C 8D 8C 8D 8D 8D 8D 8D 8D
8D 8E 8D 8D 8D 8E 8D 8E 8D 8E 8E 8E 8E 8F 8F 90 8F
8F 8F 8F 8F 8F 8F 8F 8F 8F 8F 90 90 90 90 8F 90
90 90 8F 8F 90 8F 90 90 8F 91 90 90 90 91 91 91 91 91 91
91 90 91 91 8F 90 90 90 90 90 90 90 8F 90 8F 90 8F 90 90
90 91 90 91 91 91 91 91 90 91 91 92 92 91 91 91 91 91 92
91 91 91 91 92 91 91 91 90 90 90 90 91 90 8F 90 8F 90 90
90 8F 8F 8F 8E 8F 8F 8E 8E 8E 8E 8E 8E 8D 8E 8D 8E
8E 8E 8F 8E 8E 8E 8E 8E 8E 8D 8D 8D 8D 8D 8C 8C 8D
8C 8C 8C 8C 8C 8C 8B 8C 8B 8B 8C 8B 8B 8B 8B 8B 8B
8B 8C 8C 8B 8C 8C 8C 8D 8D 8D 8C 8C 8C 8C 8C
8B 8A 8A 8A 8A 8B 8A 8A 8A 8A 8B 8A 8B 8A 8B 8B 8A
8B 8B 8A 8A 8B 8B 8A 8A 8B 8B 8B 8C 8B 8B 8C 8B 8B
8C 8B 8B 8B 8B 8B 8B 8B 8B 8B 8C 8B 8C 8C 8C 8D 8D
8E 8E 8E 8E 8E 8E 8F 8F 8F 8F 8E 8E 8E 8E 8E 8E 8E 8E
8E 8E 8E 8E 8E 8D 8E 8E 8E 8E 8E 8E 8E 8E 8E 8E 8E
8E 8E 8E 8E 8F 8F 8F 8E 8F 8E 8F 8E 8E 8E 8D 8D 8D
8D 8D 8C 8C 8C 8C 8D 8D 8D 8D 8C 8C 8C 8C
8B 8B 8B 8B 8B 8A 8B 8B 8B 8B 8B 8C 8C 8B 8C 8B 8B
8B 8B 8B 8B 8A 8A 8A 8A 8A 89 8A 89 89 8A 89 89 89
89 89 89 89 89 89 89 89 89 89 88 89 89 89 89 89 89 89
89 89 89 89 89 89 89 89 89 89 89

91 91 91 91 91 91 91 91 91 91 91 91 91 91 90 91 92 91 91 92 91 92 90 92 91 91 92 92 92 92 91 91 92 90 91 90 91 90 91 90 92 90 91 91 90 90 91 91 90 90 90 90 90 90 90 90 90 90 90 90 92 91 90 90 90 90 90 91 91 90 90 8F 91 8F 90 91

Figure 4:
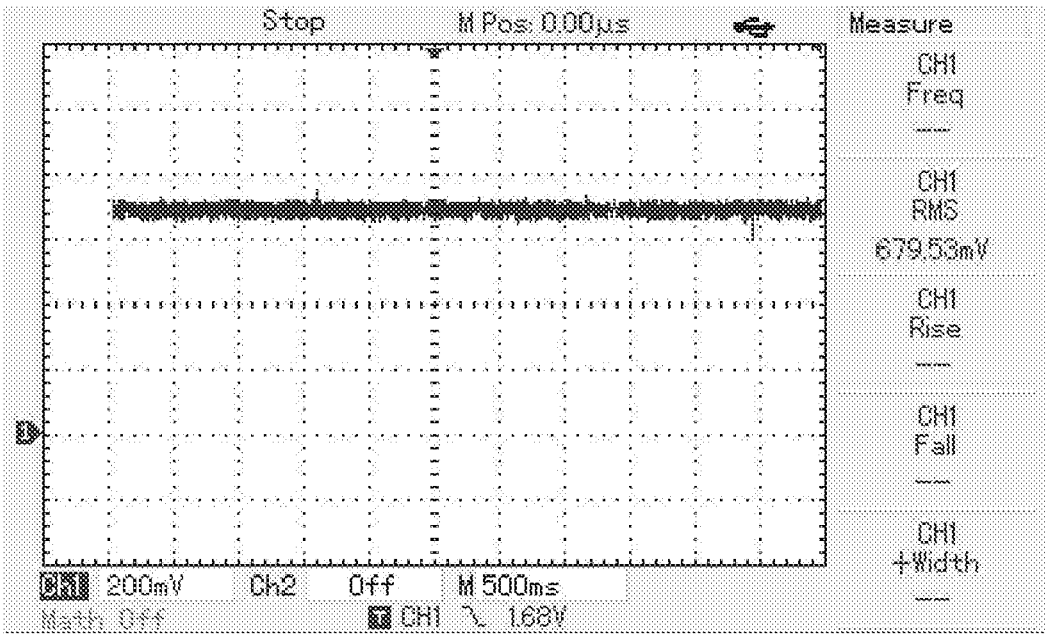
FIG. 4 is a waveform diagram of a signal sensed when a human body is in a static state in one embodiment of the present disclosure.

As seen from the sampled data for the human body in the static state and as seen in FIG. 4, the waveform change amplitude is mainly within the range of 80-9F, with the range of the waveform vibration amplitude basically unchanged. By assuming that all the other sampled data conforming to the data change law correspond to the human body in the static state, then the processing unit can determine that a human body is in the static state through fuzzy operations. Of course, the static state in theory is not limited to human bodies.

Figure 5:
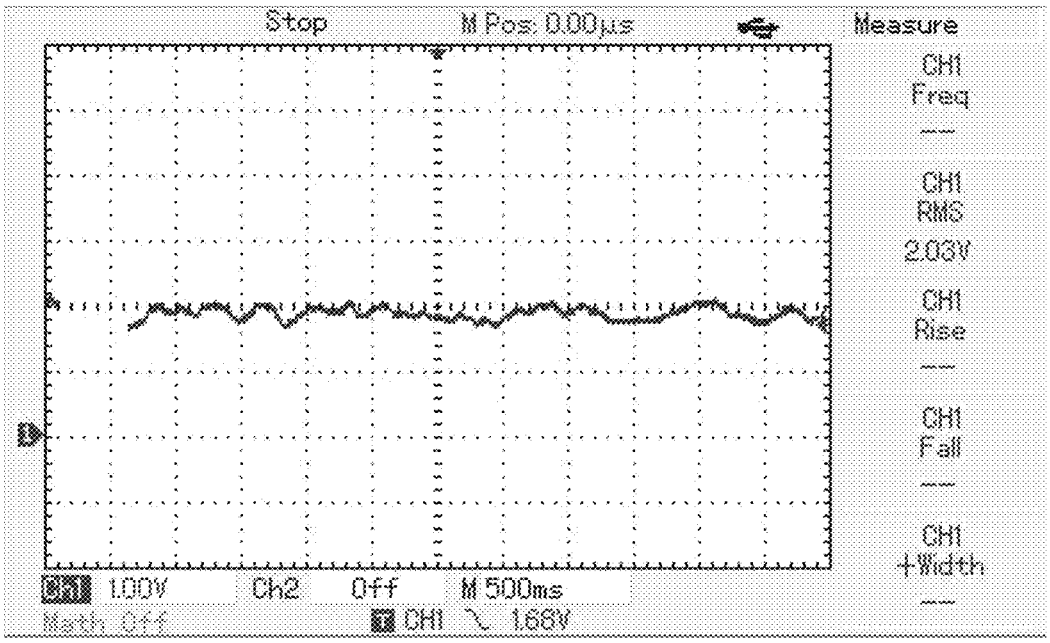
FIG. 5 is a waveform diagram of a signal sensed when a human body is in a static state after fuzzy operation processing in one embodiment of the present disclosure.

FIG. 5 shows a waveform obtained by processing the sensed data for human bodies in a static state through fuzzy operations. The processing unit sends out control signals after comparing data represented by such waveforms with the database exactly.

Furthermore, another embodiment is shown as below. The following hexadecimal data is the real-time AD sampled values within a certain time period when a human body is in a continuous movement state, as shown in FIG. 6, which reflects microwave sensing data of the human body in the continuous movement state.

A0 9D 9A 97 94 90 8E 8B 88 85 83 80 7E 7C 79 77 75 72 70 6E 6C 69 67 65 63 61 5F 5D 5B 59 57 55 53 52 4F 4E 4D 4B 49 47 46 44 43 40 3F 3E 3C 3A 39 38 36 35 32 32 30 2F 2E 2C 2B 2A 29 27 26 25 24 23 21 20 1F 1E 1C 1C 1B 19 18 17 16 15 15 13 12 11 10 0F 0E 0D 0C 0C 0B 0A 09 08 08 07 06 06 05 05 04 04 03 03 02 02 01 02 02 02 02 02 02 02 02 02 02 02 02 03 03 03 03 03 03 03 04 03 03 04 04 05 05 05 06 06 07 07 07 07 08 08 09 0A 0A 0B 0C 0C 0D 0E 0F 10 11 12 13 14 15 16 18 19 1A 1B 1C 1E 1F 20 22 23 25 26 28 29 2B 2C 2E 30 31 33 34 36 38 39 3C 3D 3F 40 42 44 46 48 4A 4C 4E 50 52 54 56 58 59 5C 5D 5F 61 64 65 66 68 6A 6C 6D 6F 72 72 74 76 78 7A 7C 7D 7F 80 82 84 84 86 87 89 8A 8B 8D 8E 90 90 92 93 94 95 97 98 99 9A 9C 9C 9D 9E A0 A1 A2 A3 A4 A5 A7 A8 A8 AA AA AC AE AE AF B1 B1 B2 B3 B4 B5 B7 B7 B9 B9 BA BB BD BC BE BE C0 C1 C2 C4 C4 C7 C6 C8 C9 CA CA CC CD CE CF D0 D1 D2 D3 D5 D6 D7 D9 DA DB DC DD DF E0 E2 E3 E4 E6 E8 E9 EC ED EF F1 F3 F6 F8 FB FC FD FD FD FE FE FE FE FE FE FE FE FE FE FE FE FE FE FE FE FE FD FE FE FE FE FE FE FE FE FD FD FE FE FE FE FE FE FE FF FE FE FE FE FE FE FE FE FE FE FE FE FE FE FE FE FE FE FD FE FE FE FE FE FE FE FE FE FE FE FE FE FE FE FD FE FE FE FE FE FE FE FE FE FE FE FE FE FE FE FD FE FE FE FE FE FE FE FE FE FE FE FE FD FE FE FE FE FE FE FE FE FE FE FE FE FE FE FE FE FE FE FE FE FE FE FE FE FE FE FE FE FD FE FE FE FE FE FE FE FE FE FE FE FE FE FE FE FE FE FE FE FE FE FE FE FE FE FE FE FE FE FE FE FE FE FE FD FC FA F9 F7 F4 F2 EF EC E8 E5 E2 DE DA D6 D2 CD C9 C5 C0 BC B7 B3 AE AA A6 A1 9D 99 95 91 8D 89 85 81 7D 7A 76 72 6E 6B 67 64 61 5D 5A56 53 50 4C 49 46 43 40 3D 3A 37 34 31 2E 2B 28 24 22 1F 1B 19 15 13 10 0D 0A 07 04 02 01 00 00 00 00 00 00 00 00 00 00 00 00 00 00 00 00 00 00 00 00 00 00 00 00 00 00 00 00 00 00 00 00 00 00 00 00 00 00 00 00 00 00 00 00 00 01 01 01 01 01 01 01 01 01 01 01 01 01 01 01 02 01 02 02 02 02 02 02 02 02 02 02 02 02 02 02 02 02 02 02 02 01 02 01 02 01 02 02 02 01 01 01 01 01 01 01 01 01 01 01 01 01 01 01 01 01 01 01 01 01 01 01 01 01 01 02 01 01 02 01 01 02 02 02 02 02 02 02 02 02 02 02 02 02 02 02 03 03 03 03 03 03 03 04 04 04 04 05 05 05 06 06 07 07 07 09 0A 0A 0C 0D 0E 0F 10 12 13 14 16 18 1A 1C 1D 1F 20 23 25 26 28 2B 2D 30 32 0C 0E 10 11 13 15 17 19 1B 1D 1F 22 25 27 2B 2D 31 33 36 3A 3D 41 44 47 4B 4E 51 55 58 5B 5F 62 65 68 6C 6F 72 76 79 7C 80 83 87 89 8C 8F 91 94 97 99 9B 9E A0 A2 A5 A7 AA AC AE B1 B3 B5 B7 B8 BB BC BE C0 C2 C5 C6 C8 CA CC CE CF D2 D4 D6 D9 DA DC DE E0 E2 E4 E6 E8 EA ED EE F0 F2 F5 F6 F9 FB FC FD FD FE FD FE FD FE FE FE FE FE FE FE FE FE FE FE FE FE FE FE FE FE FE FE FE FE FD FE FE FE FE FE FE FE FE FE FE FE FE FE FE FE FE FE FE FE FE FE FE FE FE FE FE FE FD FE FE FE FE FE FE FE FD FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FE FD FE FE FE FE FE FE FE FE FE FE FE FE FE FE FE FE FE FE FE 46 45 44 43 41 40 3F 3E 3D 3C 3A 3A 39 38 37 35 34 33 32 31 31 30 2F 2F 2E 2F 2F 2E 2D 2D 2D 2C 2D 2C 2C 2C 2C 2C 2C 2C 2C 2C 2C 2C 2D 2D 2D 2E 2F 2F 2F 30 31 31 32 32 33 34 34 35 36 37 39 3A 3B 3D 3D 3E 40 41 42 44 46 47 48 4A 4B 4C 4E 4F 51 52 54 55 57 59 5B 5D 5E 60 62 63 64 66 67 69 6B 6D 6E 6F 71 72 74 76 78 79 7B 7C 7F 80 81 83 85 87 87 8A 8A 8C 8E 8E 90 91 92 94 96 97 98 9A 9B 9C 9E 9F A1

Figure 6:
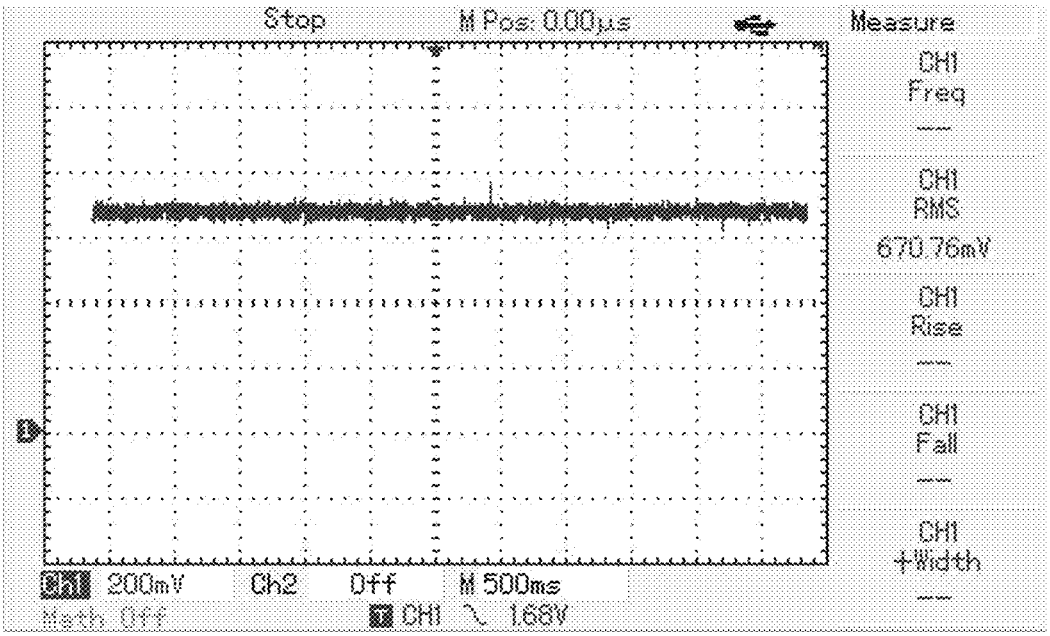
FIG. 6 is a waveform diagram of a signal sensed when a human body continuously moves in one embodiment of the present disclosure.

As seen from the sampled data for the human body in a certain continuous movement state and as seen in FIG. 6, the waveform vibration amplitude has a relatively large range. By assuming that all the other sampled data conforming to the data change law correspond to continuous human body movements, then the processing unit can determine that the human bodies are in the continuous movement state through fuzzy operations.

Figure 7:
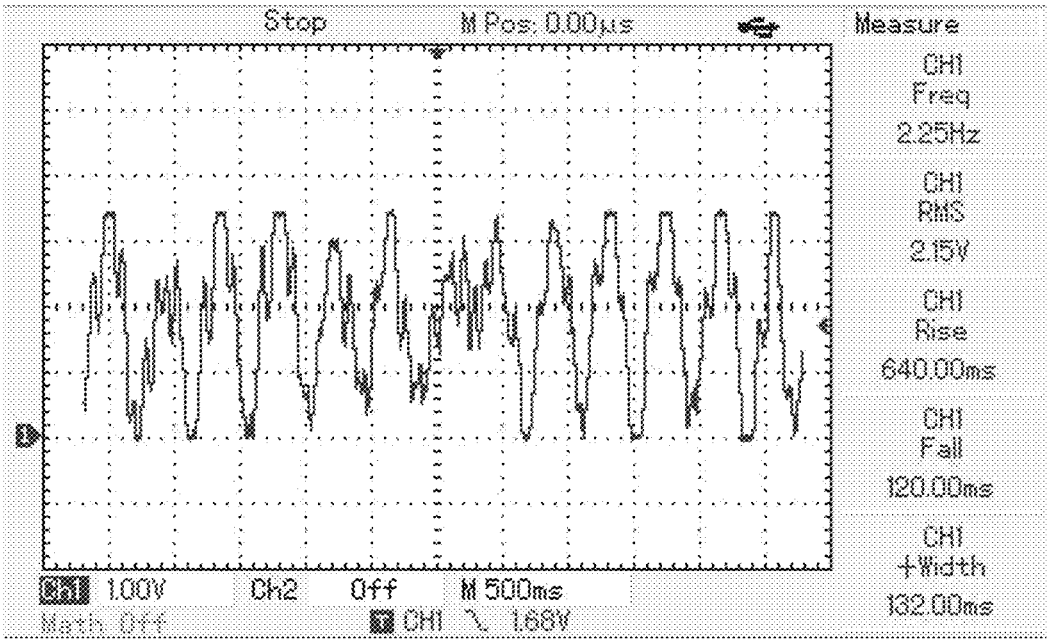
FIG. 7 is a waveform diagram of a signal sensed when a human body continuously moves after fuzzy operation processing in one embodiment of the present disclosure.

FIG. 7 shows a waveform obtained by processing the sensed data for human bodies in a continuous movement state through fuzzy operations. The processing unit sends out control signals after comparing data represented by such waveforms with the database exactly.

Furthermore, another embodiment is shown as below. The following hexadecimal data is the real-time AD sampled values within a certain time period when a human body is in a hand-waving regulation movement state, as shown in FIG. 8, which reflects microwave sensing data of the human body in the hand-waving movement state.

9C 9C 9C 9D 9D 9C 9D 9D 9E 9E 9E 9E 9D 9E 9E 9E 9E 9E 9F 9E 9E 9E 9E 9E 9E 9E 9E 9E 9E 9E 9E 9E 9E 9E 9E 9E 9E 9E 9E 9E 9E 9E 9E 9E 9E 9E 9E 9D 9D 9E 9D 9D 9C 9D 9D 9C 9D 9D 9C 9C 9D 9D 9D 9D 9D 9D 9D 9D 9D 9D 9D 9E 9D 9D 9D 9E 9D 9D 9D 9C 9D 9D 9D 9D 9D 9C 9C 9C 9C 9C 9C 9C 9C 9C 9B 9A9B 9A 9A 9A 9A 9A 9A 9A 9A 9A 9A 9A 9A 99 99 9A 99 99 98 99 99 99 98 98 98 99 99 9A 99 98 99 98 98 98 98 97 98 97 97 97 97 97 97 97 97 97 97 97 97 97 97 97 97 97 97 96 97 96 96 97 96 97 96 97 97 97 97 97 97 97 97 97 96 97 97 97 97 97 97 96 97 97 97 98 97 97 97 97 97 97 96 97 97 96 96 96 96 96 96 96 96 97 96 96 96 96 96 96 96 96 96 96 95 96 95 96 95 95 95 95 95 95 95 95 95 95 95 96 96 95 95 96 95 96 96 96 96 95 96 96 96 96 96 96 96 96 96 97 96 96 96 95 96 96 96 96 96 96 96 96 96 96 96 96 96 96 96 96 95 96 96 95 95 95 95 95 95 94 94 94 93 93 94 93 93 93 93 93 92 93 92 92 92 92 92 91 91 92 91 92 91 91 91 91 91 91 91 91 91 91 90 90 90 90 90 90 90 90 90 91 90 90 91 91 90 91 91 90 91 90 91 91 90 90 90 90 90 90 90 90 90 90 90 90 90 90 90 91 90 91 8F 90 90 90 90 90 8F 90 8F 8F 90 90 90 90 90 90 90 90 90 90 90 90 90 90 8F 90 90 90 90 90 90 8F 91 8F 91 90 90 91 91 90 90 90 90 90 90 90 90 90 90 90 90 90 90 90 90 90 90 90 8F 8F 8F 8F 8F 8F 8F 8F 8E 8F 8E 8E 8E 8E 8E 8E 8E 8E 8E 8E 8D 8D 8D 8E 8D 8D 8D 8D 8D 8D 8D 8D 8D 8D 8E 8D 8D 8D 8D 8D 8D 8C 8D 8C 8D 8C 8C 8C 8C 8C 8C 8B 8C 8C 8B 8C 8B 8C 8C 8C 8C 8C 8C 8C 8C 8B 8B 8B 8B 8C 8C 8B 8B 8B 8C 8B 8C 8C 8C 8C 8C 8D 8C 8C 8C 8C 8C 8C 8D 8D 8C 8C 8D 8C 8D 8D 8E 8D 8E 8D 8D 8D 8D 8D 8D 8D 8D 8D A6 A6 A6 A6 A6 A7 A6 A6 A7 A7 A7 A8 A8 A9 AA AA AC AB AC AE AE AF B0 B1 B1 B2 B3 B3 B3 B4 B4 B4 B4 B5 B7 B8 BA BD BF C2 C5 C7 CB CD D0 D1 D3 D5 D7 D9 DB DEE1 E3 E6 E9 EC EF F2 F5 F7 F9 FB FC FD FD FD FE FE FE FD FE FE FE FE FE FE FE FD FE FE FE FD FE FE FE FE FE FE FE FD FE FE FE FE FE FE FE FE FE FE FE FE FE FE FE FD FE FE FE FE FE FE FE FE FE FE FE FE FE FE FE 9A 9B 9A 9A 9A 9A 9 A 99 99 99 9A 98 99 99 99 99 99 99 99 99 99 99 99 99 99 99 99 99 99 99 99 99 9A 99 99 99 9A 9A 9A 9A 9A 9A 9A 9A 9A 9A 99 99 9A 99 9A 99 9A 9B 9A 99 9A 9A 9A 99 99 99 99 99 99 99 99 99 99 99 99 99 99 99 98 99 99 99 99 99 99 99 99 99 99 99 98 99 98 98 99 98 97 98 98 97 97 97 97 97 97 97 97 97 97 97 97 97 97 97 97 97 96 96 97 96 96 96 97 97 96 96 96 96 96 96 96 96 96 96 96 96 96 95 95 95 96 96 96 95 96 96 96 96 96 95 96 95 95 95 95 94 95 94 95 94 94 95 95 95 94 94 94 95 94 94 94 95 94 94 94 94 94 94 94 93 93 94 93 93 93 93

Figure 8:
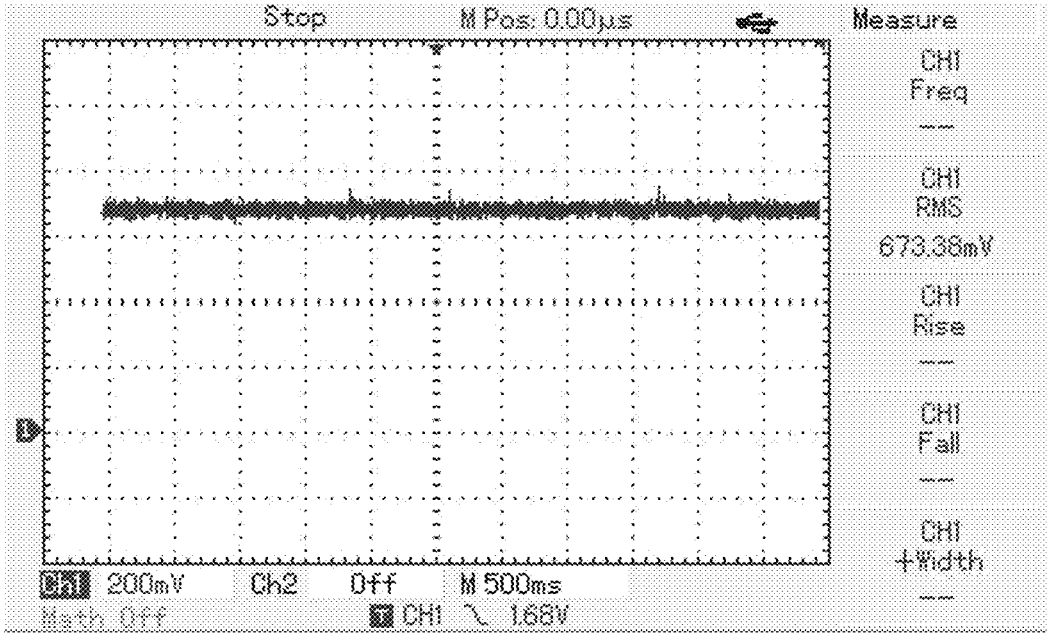
FIG. 8 is a waveform diagram of a signal sensed when a human body waves one hand to regulate in one embodiment of the present disclosure.

As seen from the sampled data for the human body in a hand-waving movement state and as seen in FIG. 8, the hand waving is in an active change state. From beginning of hand waving to ending of hand waving, the data change law has the movement characteristics of being gentle firstly, then sharply fluctuating and afterwards being gentle again. By assuming that all the other sampled data conforming to the data change law correspond to hand-waving regulation movements of human bodies, the processing unit can determine that the human bodies are in the hand-waving regulation state through fuzzy operations.

Figure 9:
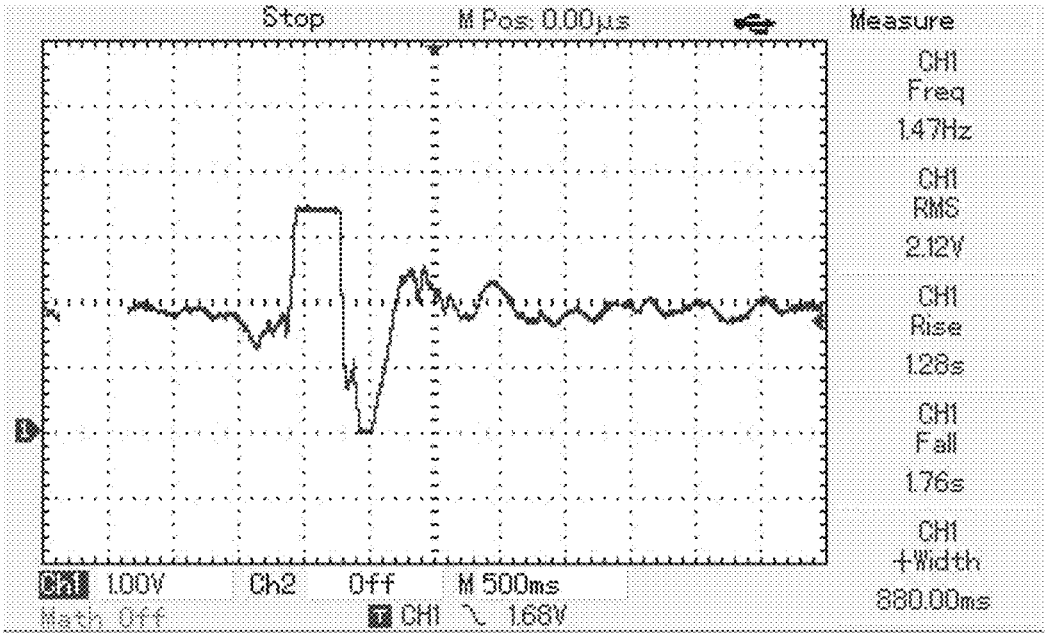
FIG. 9 is a waveform diagram of a signal sensed when a human body waves one hand to regulate after fuzzy operation processing in one embodiment of the present disclosure.

FIG. 9 shows a waveform obtained by processing the sensed data for human bodies in a hand-waving regulation state through fuzzy operations. The processing unit sends out control signals after comparing data represented by such waveforms with the database exactly to regulate the power level of the air conditioner.

Refer to the embodiments and relevant FIGS. 4-9 for the sampling and fuzzy operations of the corresponding signals involved in the previous function against a false triggering action disclosed by the disclosure.

In addition, it should be noted that the disclosure does not exclude the implementation way of waving one hand to directly set the preset target values, including but not limited to preset target values related to temperature, humidity and air velocity.

Figure 10:
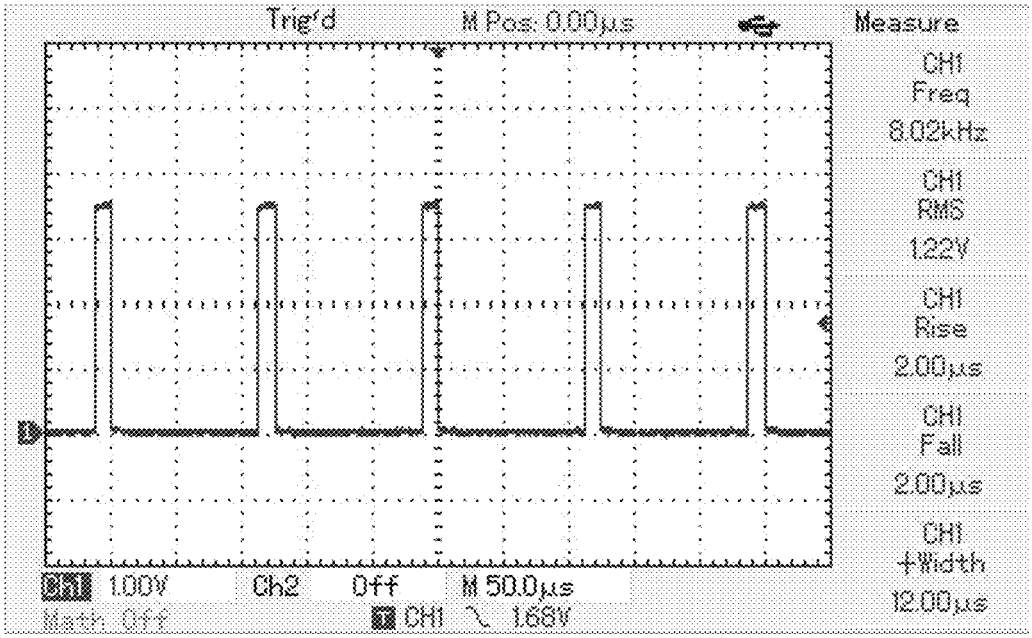
FIG. 10 to FIG. 11 are diagrams of control signals corresponding to PWM for regulating the power of the air conditioner to different powers in one embodiment of the present disclosure.
Figure 11:
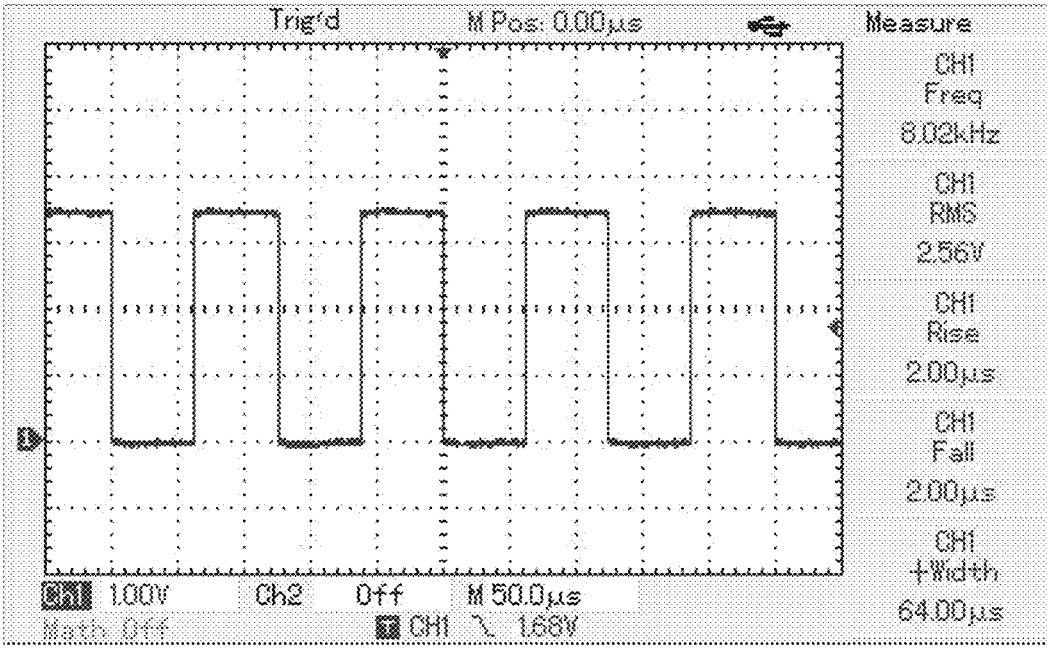

For the variable frequency air conditioner, the square wave pulse width modulation is taken for instance. Furthermore, FIGS. 10 and 11 show diagrams of control signals corresponding to PWM for regulating the power of the air conditioner to different powers.

The specific examples are used to state the principle and implementation of the present disclosure. The embodiments are used only to help understand the technical scheme and core ideas thereof of the present disclosure; and those skilled in the art can make variations in the respects of the detailed description and the scope of application based on the ideas of the present disclosure. In conclusion, the specification shall not be understood as limitation to the present disclosure.

What the claimed is:

1. An air conditioner driving device, comprising a sensing unit and a processor, wherein the sensing unit at least comprises a first sensor for microwave sensing comprising a microwave oscillator with an operating frequency of 5.4 GHz, a loop antenna and a microwave transistor arranged in the microwave sensing module;

the sensing unit also comprises a second sensor comprising an infrared sensor, and the second sensor is used for periodically outputting an environment temperature and humidity sensing signal to the processor according to a certain temperature sensing cycle and a certain humidity sensing cycle and based on temperature and humidity sensing in the environment where an air conditioner works, so that the processor uses the environment temperature and humidity sensing signal to adaptively control the turn-on and the turn-off of the air conditioner and adaptively regulate the working power of the air conditioner;

the sensing unit further comprises a third sensor for periodically outputting an air velocity sensing signal to the processor according to an air velocity sensing cycle and based on air velocity sensing in the environment where the air conditioner works, so that the processor uses the air velocity sensing signal to adaptively control the turn-on and the turn-off of the air conditioner and adaptively regulate the working power of the air conditioner;

the sensing unit is at least used for sensing whether any human activity exists within the action range based on microwave sensing according to a microwave sensing cycle, and periodically outputting a sensing signal to the processor; and the processor is used for processing the sensing signal, so that the driving device can adaptively control the turn-on and turn-off of the air conditioner and adaptively regulate the working power of the air conditioner;

according to different effects of (a) surface area features and movement features of humans and an object different from the humans, (b) distances of the humans and the object to the microwave sensing module on microwave sensing signals; (c)temperature features of the humans and the object, the processor is used for preventing the object from falsely triggering the turn-on and turn-off of the air conditioner and falsely triggering air conditioner power regulation;

the sensor unit, the processor and the air conditioner are mechanically connected to each other in a serial connection;

through the fuzzy operation, the processor determines whether a human body is in a static state, a continuous movement state, and in a hand-waving regulation state, and regulates power level of the air conditioner by way of waving one hand of the human body; and the certain microwave sensing cycle, the certain temperature sensing cycle, the certain humidity sensing cycle and the certain air velocity sensing cycle are the same cycle T being 1 second.

2. The driving device according to claim 1, wherein the processor is used for processing a signal output by the sensing unit into a digital signal required by the control module and outputting the digital signal to the control module;

the processor is used for outputting a control signal to the air conditioner driving module after conducting fuzzy operation on the received digital signal and comparing the digital signal with control strategies in a database; and the processor is used for adaptively controlling the turn-on and turn-off of the air conditioner and adaptively regulating the working power of the air conditioner according to the control signal.

3. The driving device according to claim 2, wherein control strategies in a database comprise the following rules:

(1) when the air conditioner is in the turn-off state or the standby state, and the digital signal is unchanged by comparing the current sensing moment with the sensing moment in the last cycle, a control signal in either the turn-off state or the standby state is maintained continuously, so that the air conditioner maintains the turn-off state or the standby state; a control signal is outputted and maintained according to the current environment temperature and humidity, so that the working state of the air conditioner is regulated to the working state corresponding to the current environment temperature and humidity; and (2) when the air conditioner is in the working state at a power level, the digital signal is unchanged by comparing the current sensing moment with the sensing moment in the last cycle, a control signal in the current working state is maintained continuously, so that the air conditioner continues to maintain the working state at the current power level;

if when at an interval sensing moment after an interval of the current sensing moment, the digital signal is still unchanged within the certain interval, then a control signal is outputted, so that the working state of the air conditioner is regulated to the working state with one level below the current power level; otherwise a control signal is outputted, so that the working state of the air conditioner is regulated to the working state with one level above the current power level, wherein the working state with one level below the current power level comprises the air conditioner standby or turn-off working state corresponding to the minimum power level; and the working state with one level above the current power level comprises the working state with the maximum power level being 100% and of the rated power.

4. The driving device according to claim 2, wherein when the user waves one hand, the first sensor for microwave sensing can sense the hand-waving movement without help of any additional modules; and wherein the processor is also used for increasing or reducing power based on the current power level or regulating power to certain power.

5. The driving device according to claim 2, wherein the certain microwave sensing cycle, the certain temperature sensing cycle, the certain humidity sensing cycle and the certain air velocity sensing cycle are different.

* * * * *